US005113953A

United States Patent [19]

Noble

[11] Patent Number: 5,113,953

[45] Date of Patent: May 19, 1992

[54] DIRECTIONAL DRILLING APPARATUS AND METHOD

[76] Inventor: James B. Noble, 17 Blackhouse Terrace, Peterhead, Scotland

[21] Appl. No.: 679,009

[22] PCT Filed: Nov. 3, 1989

[86] PCT No.: PCT/GB89/01318

§ 371 Date: May 1, 1991

§ 102(e) Date: May 1, 1991

[87] PCT Pub. No.: WO90/05235

PCT Pub. Date: May 17, 1990

[30] Foreign Application Priority Data

Feb. 15, 1989 [GB] United Kingdom ..... 8903447
Jun. 13, 1989 [GB] United Kingdom ..... 8913594
Nov. 3, 1989 [GB] United Kingdom ..... 8825771

[51] Int. Cl.[5] ..... E21B 7/08

[52] U.S. Cl. ..... 175/61; 175/73; 175/76

[58] Field of Search ..... 175/61, 73, 75, 76

[56] References Cited

U.S. PATENT DOCUMENTS 3,743,034 7/1973 Bradley ..... 175/61
4,577,701 3/1986 Dellinger et al. ..... 175/61
4,667,751 5/1987 Geczy et al. ..... 175/61
4,697,651 10/1987 Dellinger ..... 175/61
4,811,798 3/1989 Falgout, Sr. et al. ..... 175/73

*Primary Examiner*—William P. Neuder
*Attorney, Agent, or Firm*—Ratner & Prestia

[57] ABSTRACT

A directional drilling apparatus and method in which the drill bit is coupled to the lower end of a drill string through a universsal joint which allows the bit to pivot relative to the string axis. The bit is contra-nutated in an orbit of fixed radius and at a rate equal to string rotation but in the opposite direction. This speed-controlled and phase-controlled bit nutation keeps the bit heading off-axis in a fixed direction. The invention enables directional drilling while the drill string rotates normally.

10 Claims, 5 Drawing Sheets

DIRECTIONAL DRILLING APPARATUS AND METHOD

This invention relates to a directional drilling apparatus and method.

When drilling oil and gas wells for the exploration and production of hydrocarbons, it is very often necessary to deviate the well off vertical and in a particular direction. Such deviation may be required, for example, when drilling from land to explore formations beneath the sea or below a lake, or in the case of oil and gas production offshore, when drilling 20 or 30 wells from the same platform, each going in a different direction to gain the widest coverage of the hydrocarbon bearing structure. The latter can result in wells being as much as 3 to 4 miles apart at the point where they pass through the production zone.

Procedures for deviating wells have improved greatly over recent years with the introduction of powerful and reliable downhole motors and downhole turbines, and the introduction of Measurement While Drilling (MWD) techniques.

Use of a downhole motor or turbine allows the hole to deviated by the introduction of a fixed offset or bend just above the drill bit and this offset or bend can be oriented by means of the MWD system which is capable of giving toolface (direction of fixed offset or bend) hole angle and azimuth, all in real time Consequently, it is possible to rotate the drill string slowly until the toolface is in the desired direction of deviation, stop rotating the drill string with the toolface pointing in the desired direction, then start the motor or turbine to extend the hole in the desired deviated direction.

There are however a number of inherent problems in this approach to directional drilling, namely:

(a) the drill string cannot be rotated while hole deviation is taking place, giving rise to the disadvantages of greater likelihood of getting stuck due to differential sticking, and difficulty in transferring weight to the bit due to drag on the static drill string;

(b) Surveys from the MWD System are taken at predetermined intervals, normally every 30 feet at the singles change (the addition of a new length of drill pipe), giving rise to the disadvantages that shift of tool face due to reactive torque of motor or turbine can only be identified after the shift has occurred, and correction of undesired hole angle change can only take place every 30 feet at the least.

In order to obviate or mitigate these problems which currently cost oil companies millions of dollars per year, it is an object of the invention to provide directional drilling apparatus and method whereby the offset or bend (toolface) can be created dynamically such that the drill string may be rotated whilst maintaining the toolface in a set direction. There is preferably also an ability to change the toolface direction whilst the drill string is rotating, in order to correct any deviation of hole caused by external influences e.g. formation change, or dip angle etc.

According to a first aspect of the present invention there is provided directional drilling apparatus for deviating a drill bit on the lower end of a drill string substantially in a selected direction, said apparatus comprising upper end coupling means for coupling the upper end of said apparatus to the lower end of the drill string, lower end coupling means for coupling of the drill bit to the lower end of said apparatus, force coupling means linking said upper and lower end coupling means for transmission of torsional and axial forces therebetween such that torque applied to said drill string in use of said apparatus is transmitted to the drill bit coupled to said lower end coupling means in use of said apparatus while axial downthrust or uplift applied to said drill string is transmitted to the coupled drill bit, said force coupling means further allowing the rotational axis of said lower end coupling means to be omni-directionally deviated with respect to the rotational axis of said upper end coupling means and the rotational axis of said drill string in use of said apparatus, characterised in that said apparatus comprises rotatable deviation direction control means for deviating the rotational axis of said lower end coupling means with respect to the rotational axis of said upper end coupling means in a direction according with rotation of said rotatable deviation direction control means, and in that said apparatus further comprises rotational drive means coupled to said rotatable deviation direction control means to contra-nutate said rotatable deviation direction control means with respect to rotation of the drillstring in use of said apparatus at a substantially equal and opposite rotational speed whereby to deviate the axis of said lower end coupling means in a direction which is spatially substantially invariant.

Thereby the directional drilling apparatus in accordance with the invention enables an angular deviation to be provided in the bottom hole assembly at the lower end of a rotating drill string, while holding the spatial direction of the deviation substantially invariant by contra-nutating the deviation forming arrangement with respect to the drill string at a substantially equal and opposite rotational speed to that of the drill string that substantially cancels out rotation-induced changes in deviation direction that would otherwise occur.

Said rotatable deviation direction control means preferably comprises an eccentric drive rotationally coupled to an upward extension of said lower end coupling means such that rotation of said eccentric drive nutates the rotational axis of said lower end coupling means with respect to the rotational axis of said upper end coupling means.

Said rotational drive means coupled to the eccentric drive or other form of rotatable deviation direction control means preferably comprises a hydraulic or electric servo motor coupled to be controlled by azimuth sensing means such that the rotational speed and rotational direction of the servo motor are equal and opposite to those of the drill string in use of said apparatus, and maintain a rotational phase relationship thereto that produces said substantial invariance in spatial direction of the deviated axis of said lower end coupling means.

The eccentric drive and hydraulic servo motor may be combined in the form of a Moineau motor, with the eccentrically rotating motor of the Moineau motor constituting the eccentric drive.

Said force coupling means may comprise a Hooke joint, or a constant velocity joint incorporating bi-directionally effective end thrust transmitting means.

As an alternative to said eccentric drive, said rotatable deviation direction control means may comprise a rotatable cam means rotatably linking said upper and lower end coupling means.

Where said servo motor is an electric servo motor, electric power therefore may be derived from an adjacent battery or from a mud-driven turbo-alternator.

Where said servo motor is a hydraulic servo motor, hydraulic power therefor may be derived from drilling mud pumped down the drill string, preferably supplied to the motor through a controllable valve.

Said azimuth sensing means may be comprised within an MWD (Measurement While Drilling) system incorporated in the lower end of drill string and operable during use of the apparatus to measure the azimuth of the lower end of the drill string, or said azimuth sensing means may be independent of the MWD system (if any).

According to a second aspect of the present invention there is provided a method of deviating a drill bit on the lower end of a drill string substantially in a selected direction, characterised in that said method comprising the steps of coupling the drill bit to the lower end of the drill string through force coupling means transmitting torsional and axial forces between the lower end of said drill string and the drill bit while allowing the rotational axis of the drill bit to be omni-directionally deviated with respect to the rotational axis of the lower end of the drill string, and contra-nutating the drill bit with respect to the lower end of the drill string at a substantially equal and opposite rotational speed whereby to deviate the rotational axis of said drill bit in a direction which is spatially substantially invariant.

Embodiments of the invention will now be described by way of example with reference to the accompanying drawings wherein:

FIG. 1 schematically illustrates a directionally deviated drill string being operated in accordance with the directional drilling method of the present invention;

FIG. 2 schematically illustrates a first configuration of drill string incorporating directional drilling apparatus in accordance with the present invention;

FIG. 3 schematically illustrates a second configuration of drill string incorporating directional drilling apparatus in accordance with the present invention;

Figure 1:
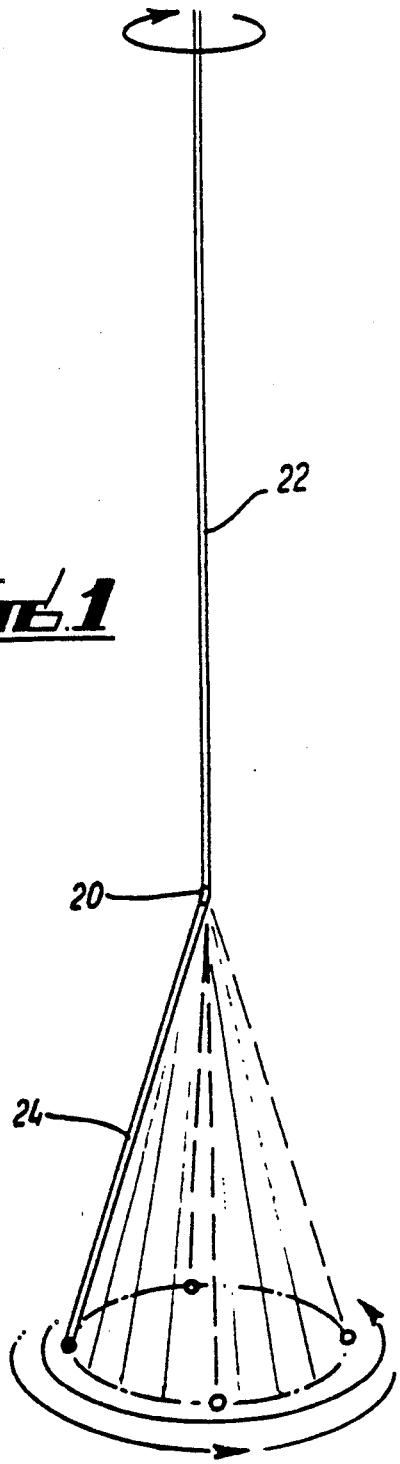

Referring to the drawings, the basic principle of the directional drilling method is schematically depicted in FIG. 1. A universal joint 20 is fitted between the upper and lower parts 22, 24 of a drill string so that the lower part 24 of the drill string is arranged at a slight angle to the upper part 22 of the drill string while transmitting torque and end thrust between them.

The joint 20 is provided with drive means which impart an anticlockwise nutation or orbital rotation to the lower part 24 of the drill string, which thus orbits around the central rotational axis of the upper part 22 of the drill string. This orbital movement is countered by clockwise rotation of the drill string from a rotary table or top drive (not shown in FIG. 1). When the two rates of rotation, one clockwise and one anticlockwise, are made equal, the lower part 24 of the drill string effectively remains at a constant angle and a fixed or spatially invariant drilling direction is established. In a typical arrangement a constant counter-clockwise nutation or orbital rotation of the lower end 24 of the drill string is established at approximately 60 RPM. A clockwise rotation of the upper part 22 of the drill string at 60 RPM establishes directional drilling, whereas a rotation of the upper part of the drill string at a greater speed, say 100–150 RPM, creates a relatively high speed wobble on the lower part 24 of the drill string for effectively straight drilling. It is thus possible to produce both oriented and non-oriented drilling by variation of the rotary speed of the drill string under control from the rig floor.

The arrangement can be made to adjust the direction of drilling by virtue of sensors within the assembly which operate in conjunction with directional information transmitted by the MWD (Measurement While Drilling) system and the control means for the rotary drive of the drill string.

Figure 2:
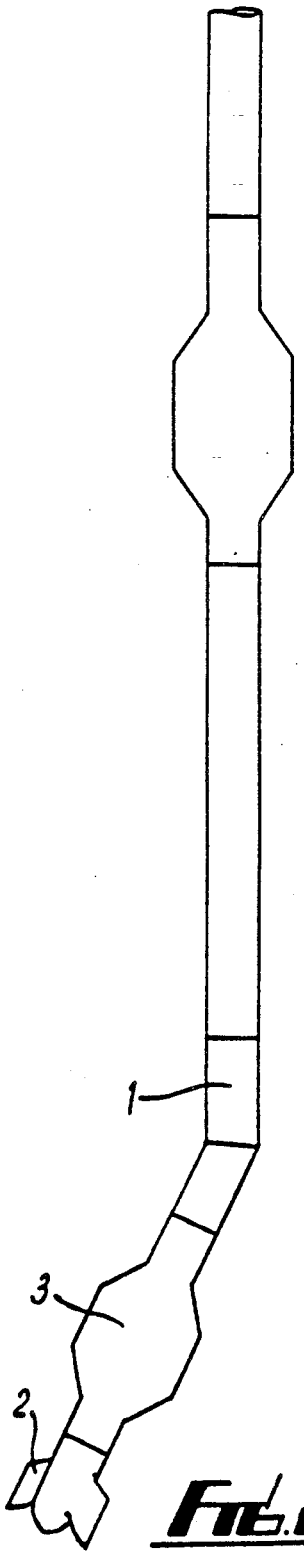
Figure 3:
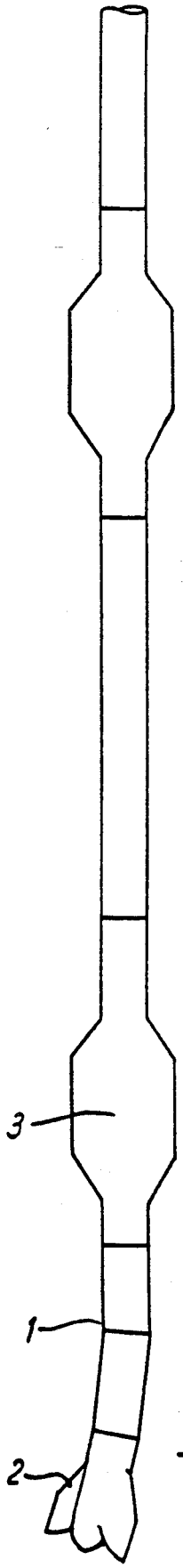

Referring now to FIGS. 2 and 3, two alternative configurations of directional drilling apparatus are illustrated. FIG. 2 shows the configuration for directional drilling when deviation angles of 0.5 degrees or greater are required. In FIG. 2 configuration a directional drilling apparatus 1 is positioned above a drill bit 2 and a stabilizer 3. FIG. 3 shows the configuration for directional drilling when deviation angles of up to 0.5 degrees are required. In the FIG. 3 configuration the directional drilling apparatus 1 is positioned between the drill bit 2 and the stabilizer 3.

Figure 4:
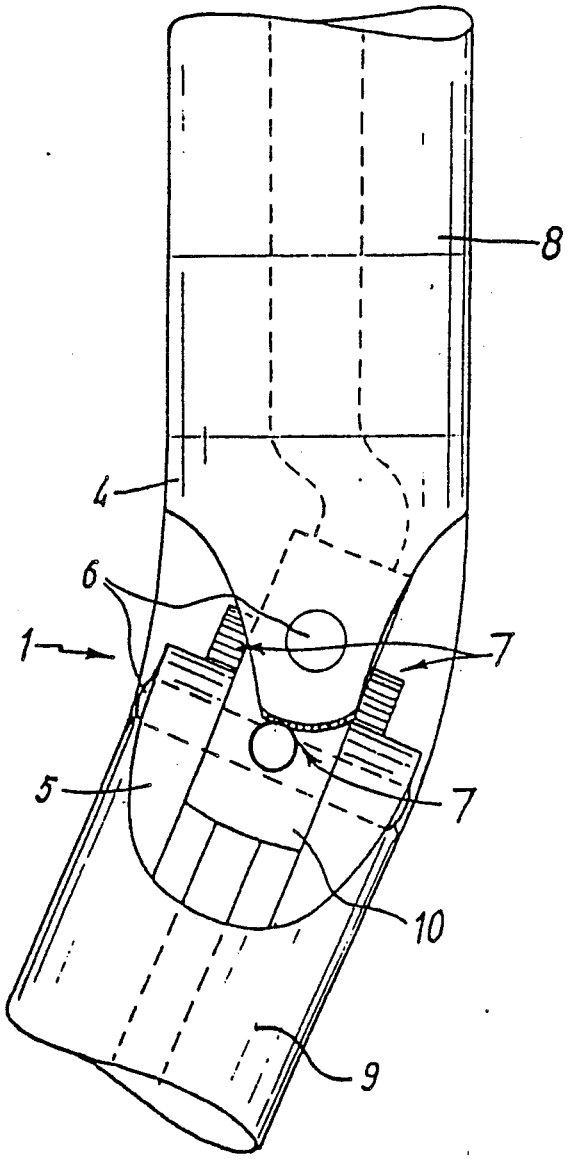
FIG. 4 is an elevation of a first embodiment of directional drilling apparatus in accordance with the present invention.

There are a number of possible embodiments of directional drilling apparatus operable as described above and a first of these is illustrated in FIG. 4. The apparatus 1 comprises a knuckle or Hooke joint assembly including an upper section 4 and a lower section 5 pivotally connected at 6 through a square drive 10. A gear arrangement 7 allows adjustment of the angle between the upper section 4 and lower section 5. The apparatus 1 fits between an upper part 8 of a drill string and a lower drill string part 9. The square drive 10 transmits torque to the lower part 9 of the drill string and hence to the drill bit. The gear arrangement 7 controls the angular bend of the assembly and can be set to provide a 0.5 degrees, 0.75 degrees or 1 degree bend in the bottom hole apparatus. Control over the rotation of the apparatus 1, and hence the orbital movement of the assembly, is achieved by electric drive means for the arrangement 7 which it is envisaged will be provided by power generated by fluid flow through a downhole generator similar to those used to power MWD systems.

Figure 5:
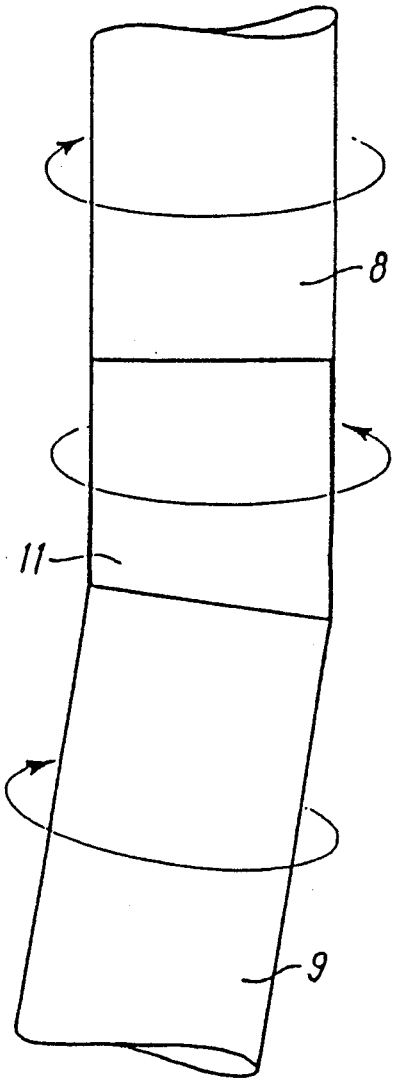
FIG. 5 is an elevation of a second embodiment of directional drilling apparatus in accordance with the present invention.

A second possible embodiment of directional drilling apparatus is illustrated in FIG. 5. In this embodiment the apparatus 1 essentially consists of a counter-rotating cam 11 which fits between the upper part 8 of the drill string and the lower part 9 of the drill string. The angle of the cam 11 determines the offset of the bottom hole assembly. Suitable drive means, not illustrated, are provided to rotate the cam 11 at the same speed as and in a direction opposite to that of the drill string.

Other arrangements are possible, for example, a Moineau motor could be employed to provide orbital rotation of the lower end of the drill string and attached drill bit, with the eccentric Moineau rotor being coupled to the lower end of the drill string to cause it to nutate. It is also envisaged that a constant velocity type joint similar to that used in many front wheel drive motor vehicles might be used in place of the Hooke joint 4, 5. In this case the the anti-clockwise rotary action of a servo motor drives a very slightly (0.5 degrees–1 degree) offset axis thereby creating the orbital motion required from the device.

Essentially, whichever arrangement is used, the directional drilling apparatus creates a known bend in a known direction of the lower portion of the drill string during rotary drilling when the anti-clockwise nutatory and clockwise drill string rotary speeds are equal. This has the advantage over conventional methods that drill string rotation can be maintained whilst drilling in the deviated mode. This alleviates the problem of hang up of stabilisers in the bore hole and lower penetration rates in non-rotational modes of deviated drilling employing downhole motors or turbines.

In many drilling applications it is difficult to maintain a uniform rotation speed for the drill string and such speed fluctuations would degrade the effective operation of the directional drilling apparatus of the invention. This problem can be overcome by including in the apparatus a control and monitoring device which monitors the instantaneous rotary speed of the drill string and controls variations of the operating speed of the apparatus such as to cancel out the upsetting effect of the drill string speed fluctuations.

The necessary monitoring is preferably achieved using accelerometers and magnetometers and a number of servo motors may be used to provide the necessary rapid response to rotary speed fluctuations of the drill string. The use of such motors downhole requires some modifications to ensure correct operation under pressure or the provision of a sealed pressure chamber to allow operation at normal atmospheric pressure.

The above is only one possible solution to the problem and it is envisaged that a number of alternative systems might be utilised. Essentially the apparatus used must achieve the basic requirement of using dynamic information from the drill string, relating to speed and torque, to control and counter-rotate a rotatable deviation direction control means which is dynamically positioned so as effectively to remain spatially invariant or stationary with respect to a fixed direction of the borehole.

A similar result to that achieved with the above can be obtained using an alternative type of apparatus which will now be described. In this alternative form of apparatus which is a variation of the FIG. 5 apparatus, a slightly different approach is taken in that the outer casing of the cam 11 is held stationary by an arrangement of blades (not illustrated in FIG. 5) which slide down the wellbore. These blades are shaped and sized such that they slide down the wellbore but are unable to rotate and so rotationally lock against the wellbore. The blades may be fixed, or the blades may be variably extendable and held retracted until at operating depth when they are fully extended, either by a fixed amount or by the force of springs.

Figures 6A, 6B, 7:
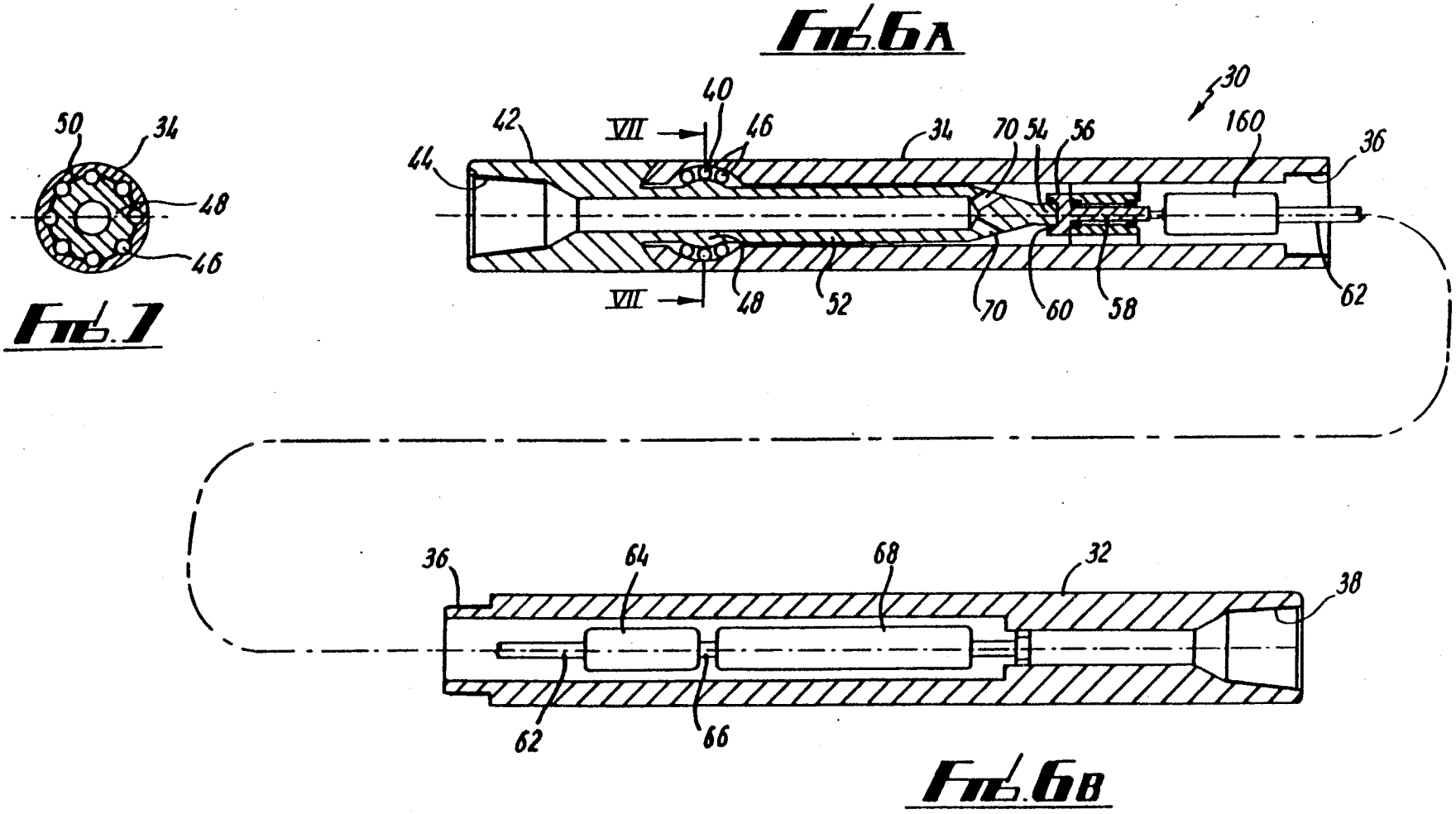
FIG 6A and 6B are longitudinal sections of (respectively) lower and upper sections of a third embodiment of directional drilling apparatus in accordance with the present invention.
FIG. 7 is a transverse section of the third embodiment, taken on the line VII—VII in FIG. 6A.

Referring now to FIGS. 6A and 6B these show a third embodiment of directional drilling apparatus 30 in accordance with the invention. The apparatus 30 comprises a two-part cylindrical casing consisting of an upper casing section 32 and a lower casing section 34 joined to the upper casing section 32 by a screw-threaded joint 36.

The upper end of the upper casing section 32 incorporates an API box connection 38 by which the apparatus 30 is coupled in use to the lower end of a drill string.

The lower end of the lower casing section 34 is formed as an articulated bearing or constant-velocity joint 40 (detailed subsequently) supporting a lower end sub-section 42 of the apparatus 30, which incorporates a further API box connection 44 to which a drill bit (or a bit-mounting sub) is coupled in use of the apparatus 30 (see FIGS. 8 and 9).

The joint 40 (transversely sectioned in FIG. 7) comprises three circumferential rings of bearing balls 46 running in longitudinal grooves inside a part-spherical hollow lower end of the lower casing section 34, and in longitudinal grooves on the outside of a part-spherical upper end 48 of the lower end sub-section 42. A cage 50 constrains the balls 46 to maintain correct mutual alignment within the joint 40. The joint 40 thus somewhat resembles a known form of constant velocity joint as typically employed in front-wheel-drive road vehicles, and the central row of balls 46 do perform a torque-transmitting function in known manner; however, the other two rows of balls 46 serve to give the joint 40 a bi-directionally effective thrust-transmitting capacity absent from conventional single-row constant velocity joints. Thus the joint 40 couples torsional and end forces between the two connections 38 and 44 while permitting the rotational axis of the lower end sub-section 42 to deviate omni-directionally from the rotational axis of the casing sections 32 and 34. Therefore in use of the apparatus 30 drilling torque can be transmitted from the drill string through the joint 40 to the drill bit, as can downthrust or uplift, without the drill string and drill bit necessarily turning co-axially.

The actual alignment of the rotational axis of the lower end sub-section 42 with respect to the rotational axis of the casing sections 32 and 34 is controlled by a rotational deviation direction control means which will now be described in detail.

The upper end 48 of the lower end sub-section 42 is upwardly extended within and clear of the lower casing section 34 by a hollow extension 52 terminated at its upper end by a concentric journal spigot 54. An eccentric 56 is secured to the end of a drive shaft 58 rotatably mounted within the lower casing section 34. The eccentric 56 is coupled to the journal spigot 54 on the extension 52 through a rotary bearing 60. Rotation of the drive shaft 58 nutates the extension 52 and causes it to orbit within the casing section 34, pivoting a small angular amount about the kinematic centre of the joint 40 which allows such relative pivotal movement; however, the extension 52 does not rotate about its longitudinal axis relative to the casing section 34 while being nutated by the eccentric 56 since the joint 40 does not allow such relative rotational movement.

The speed and direction of rotation of the drive shaft 58 and hence of the eccentric 56 are determined by an electric servo motor 60 controllably powered through a cable 62 from a servo control unit 64 deriving control and motive power through a cable 66 from a battery pack 68 also containing position sensors.

The servo motor 60, the control unit 64, and the battery pack 68 are securely mounted within the hollow interior of the casing sections 32 and 34, and are dimensioned to leave fluid passages around them. Apertures 70 in the upper end of the hollow extension 52 complete the ability of the apparatus 30 to pass fluid (e.g. drilling mud) internally through its length from the connection 38 to the connection 44, and hence hydraulically link the drill string to the drill bit in use of the apparatus 30.

The position sensors housed in the battery pack 68 may comprise magnetometers and/or accelerometers or any other suitable arrangements for sensing the instantaneous azimuth or direction of a predetermined hypothetical reference radius of the apparatus 30. From the direction measurements, the servo control unit 64 powers the servo motor 60 to turn the drive shaft 58 and hence the eccentric 56 in a direction and at a rotational speed that is substantially exactly equal and opposite to the drill-string-induced rotation of the apparatus 30, while moreover maintaining a phase relationship between these equal and opposite rotations that causes the eccentric 56 to maintain an offset position that is spatially substantially invariant and in the chosen direction of deviation. (As an alternative to using special-purpose position sensors in the pack 68, the control unit 64 may derive position signals from an MWD system).

The net result is a contra-nutation of the extension 52 that cancels out rotation of the drill string to keep the lower end sub-section 42 axially aligned in the selected direction of deviation of the well bore. Simultaneously, the joint 40 is transmitting the bit-turning rotation of the drill string to the bit to cause the well bore to be extended and deepened in the intended direction of deviation.

Since the eccentric 56 has a fixed eccentricity, the easiest procedure for converting the apparatus 30 to cause undeviated drilling, is to nutate the extension 52 at a rate which is unrelated to the precisely speed-controlled and phase-controlled rate required for directional drilling; this is preferably achieved simple by stopping the servo motor 60. Thereupon the drill bit will undergo an indeterminate wobble or eccentric motion that effectively drills on an undeviated straight axis, possibly producing a slightly greater bore diameter than the true bit diameter.

Instead of nutating by orbiting at a fixed radius, the nutatory mechanism (whether an eccentric drive o any other form) could be adjustable so as to enable controllably variable angular deviations from zero up to the mechanism-limited maximum deviation angle to give deviation angle control as well as the deviation direction control previously described.

Figure 8:
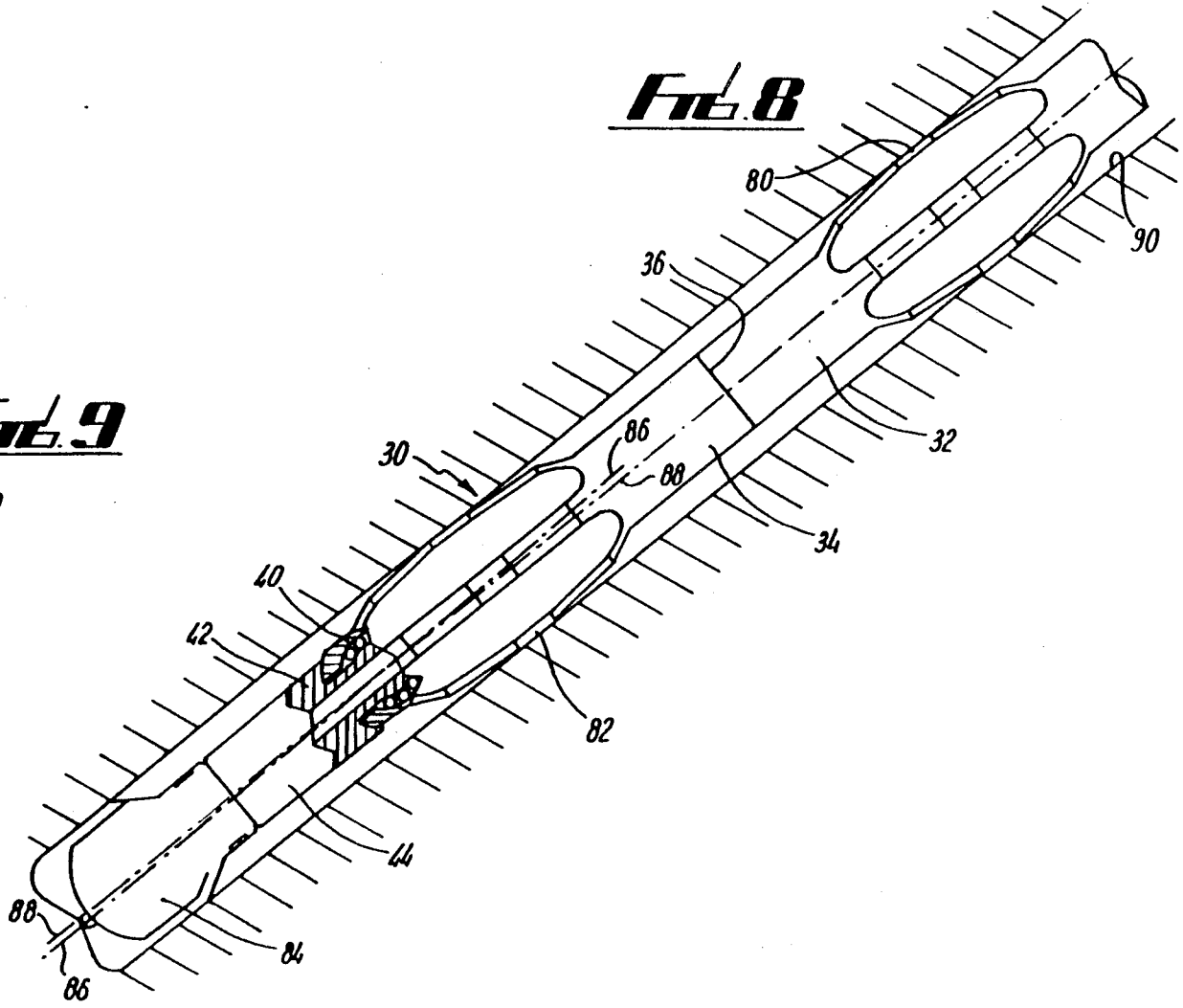
FIG. 8 is a part-sectioned elevation of the third embodiment in use for drilling an undeviated well bore.

FIG. 8 shows the third embodiment of FIGS. 6A, 6B and 7 in use for drilling a deviated well. The directional drilling apparatus 30 has its upper and lower casing sections 32 and 34 formed as or secured within upper and lower stabilisers 80 and 82. The upper stabiliser 80 is a full gauge stabiliser with a maximum outside diameter substantially equal to the nominal bore diameter of the well being drilled, and the lower stabiliser 82 may have the same or a slightly lesser diameter.

Figure 9:
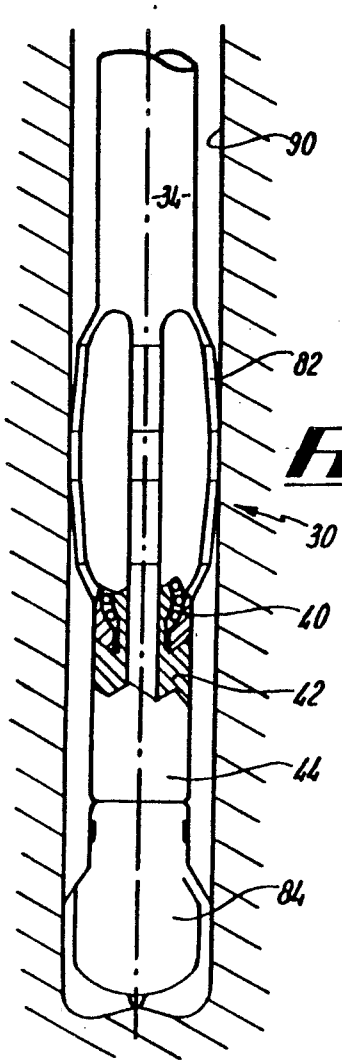
FIG. 9 is a part-sectioned elevation of the third embodiment in use for drilling a deviated well bore.

The drill string to which the apparatus 30 is connected in use (via the API connection 38) is not shown in FIG. 8 or FIG. 9, but a drill bit 84 is shown connected to the lower end of the apparatus 30 (via the API connection 44).

In the FIG. 8 configuration, the servo motor 60 is controlled by the control unit 64 (drawing power from the battery pack 68) to contra-nutate the lower end sub-assembly 42 relative to the drill string rotation, at an equal rotational speed and in the opposite rotational direction, and with rotational phase relationship such that the rotational axis 86 of the drill bit 84 is deviated downwards (as viewed in FIG. 8) by a small angle relative to the rotational axis 88 of the remainder of the apparatus 30 and of the neighbouring section of the drill string. This results in the well bore 90 being extended and deepened along a line deviated from the line of the already-bored well, as the drill string rotates the drill bit 84 to bore through the surrounding geological formation.

In FIG. 9, the directional drilling apparatus 30 is set for undeviated boring, either by stopping the servo motor 60, or by reducing the nutatory orbital radius substantially to zero (in the case of an eccentric drive, as in FIG. 6A, by reducing the eccentricity to zero by suitable adaptation of the FIG. 6A eccentric drive).

In all the above described embodiments of the invention, rotation of the drill string is assumed to be induced over its whole length (for example, by a surface-level rotary drive). However, some of the advantages of the invention, principally those of keeping the string rotating in a curved section of bore, can be obtained by fitting a motor or turbine part way down the drill, below the surface and above the directional drilling apparatus of the invention. The drill string down to the motor or turbine can then be stationary, and only the string below the motor or turbine will rotate during drilling, with the direction drilling apparatus of the invention enabling deviation direction control of the rotating lower end of the string.

While certain modifications and variations have been described above, the invention is not restricted thereto, and other modifications and variations can be adapted without departing from the scope of the invention as defined in the appended claims.

I claim:

1. Directional drilling apparatus for deviating a drill bit on the lower end of a drill string substantially in a selected direction, said apparatus comprising upper end coupling means for coupling the upper end of said apparatus to the lower end of a said drill string, lower end coupling means for coupling of the drill bit to the lower end of said apparatus, force coupling means linking said upper and lower end coupling means for transmission of torsional and axial forces therebetween such that torque applied to said drill string in use of said apparatus is transmitted to the drill bit coupled to said lower end coupling means in use of said apparatus while axial downthrust or uplift applied to said drill string is transmitted to the coupled drill bit, said force coupling means further allowing the rotational axis of said lower end coupling means to be omni-directionally deviated with respect to the rotational axis of said upper end coupling means and the rotational axis of said drill string in use of said apparatus, characterised in that said apparatus comprises rotatable deviation direction control means for deviating the rotational axis of said lower end coupling means with respect to the rotational axis of said upper end coupling means in a direction according with rotation of said rotatable deviation direction control means, and in that said apparatus further comprises rotational drive means coupled to said rotatable deviation direction control means to contra-nutate said rotatable deviation direction control means with respect to rotation of the drillstring in use of said apparatus at a substantially equal and opposite rotational speed whereby to deviate the axis of said lower end coupling means in a direction which is spatially substantially invariant.

2. Apparatus as claimed in claim 1 characterised in that said rotatable deviation direction control means comprises an eccentric drive rotationally coupled to an upward extension of said lower end coupling means such that rotation of said eccentric drive nutates the rotational axis of said lower end coupling means with respect to the rotational axis of said upper end coupling means.

3. Apparatus as claimed in claim 2 characterised in that said rotational drive means coupled to the eccentric drive comprises a hydraulic or electric servo motor coupled to be controlled by azimuth sensing means such that the rotational speed and rotational direction of the servo motor are equal and opposite to those of the drill string in use of said apparatus, and maintain a rotational phase relationship thereto that produces said substantial invariance in spatial direction of the deviated axis of said lower end coupling means.

4. Apparatus as claimed in claim 3 characterised in that the eccentric drive and hydraulic servo motor are combined in the form of a Moineau motor, with the eccentrically rotating rotor of the Moineau motor constituting the eccentric drive.

5. Apparatus as claimed in claim 1 characterised in that said force coupling means comprises Hooke joint.

6. Apparatus as claimed in claim 1 characterised in that said force coupling means comprises a constant velocity joint incorporating bi-directionally effective end thrust transmitting means.

7. Apparatus as claimed in claim 1 characterised in that said rotatable deviation direction control means comprises a rotatable cam means rotatably linking said upper and lower end coupling means.

8. Apparatus as claimed in claim 3 characterised in that said azimuth sensing means is comprised within an MWD (Measurement While Drilling) system incorporated in the lower end of drill string and operable during use of the apparatus to measure the azimuth of the lower end of the drill string.

9. Apparatus as claimed in claim 3 characterised in that said azimuth sensing system is independent of any MWD (Measurement While Drilling) system incorporated in the lower end of the drill string.

10. A method of deviating a drill bit on the lower end of a drill string substantially in a selected direction, characterised in that said method comprises the steps of coupling the drill bit to the lower end of the drill string through force coupling means transmitting torsional and axial forces between the lower end of said drill string and the drill bit while allowing the rotational axis of the drill bit to be omni-directionally deviated with respect to the rotational axis of the lower end of the drill string, and contra-nutating the drill bit with respect to the lower end of the drill string at a substantially equal and opposite rotational speed whereby to deviate the rotational axis of said drill bit in a direction which is spatially substantially invariant.

* * * * *

UNITED STATES PATENT AND TRADEMARK OFFICE

CERTIFICATE OF CORRECTION

PATENT NO. : 5,113,953

DATED : May 19, 1992

INVENTOR(S) : James B. Noble

It is certified that error appears in the above—identified patent and that said Letters Patent is hereby corrected as shown below:

On title page, insert item

[30] Foreign Application Priority Data

Feb. 15, 1989 [GB] United Kingdom ..... 8903447
Jun. 13, 1989 [GB] United Kingdom ..... 8913594
Nov. 3, 1988 [GB] United Kingdom ..... 8825771

Signed and Sealed this

Fourteenth Day of September, 1993

Bruce Lehman

*Attest:*

BRUCE LEHMAN

*Attesting Officer*

*Commissioner of Patents and Trademarks*